US005790991A

United States Patent [19]

Johnson

[11] Patent Number: 5,790,991

[45] Date of Patent: Aug. 11, 1998

[54] APPARATUS FOR AUTOMATICALLY REGULATING WATER LEVEL IN A SWIMMING POOL

[76] Inventor: Charles F. Johnson, 2234 S. Gaucho, Mesa, Ariz. 85202

[21] Appl. No.: 829,352

[22] Filed: Mar. 31, 1997

[51] Int. Cl.[6] ..... E04H 4/12

[52] U.S. Cl. ..... 4/508; 137/428; 137/423

[58] Field of Search ..... 4/507, 508, 509; 137/393, 398, 409, 423, 426, 428, 429, 432

[56] References Cited

U.S. PATENT DOCUMENTS

| | | | |
|---|---|---|---|
| 2,542,591 | 2/1951 | Streety et al. | 137/398 |
| 3,739,405 | 6/1973 | Schmidt | 137/428 |
| 4,524,794 | 6/1985 | Haines | 137/423 |
| 4,686,718 | 8/1987 | Kinkead et al. | 137/428 |
| 4,972,530 | 11/1990 | Snyder | 4/508 |
| 5,154,205 | 10/1992 | Langill | 137/393 |
| 5,367,723 | 11/1994 | Pleva et al. | 137/428 |
| 5,459,886 | 10/1995 | Payne et al. | 4/508 |
| 5,596,773 | 1/1997 | Cueman | 4/508 |
| 5,655,232 | 8/1997 | Buckwalter | 4/508 |

*Primary Examiner*—Charles R. Eloshway
*Attorney, Agent, or Firm*—Spencer E. Olson

[57] ABSTRACT

Apparatus for monitoring and controlling the level of water in a swimming pool includes a vertically elongated vessel partially-buried below the pool water level at a location close to the return line from the filter to the pool inlet, a connector pipe extending from the vessel to the return line for allowing pool water at sub-level pressure to enter the vessel and rise to the pool water level, and a float-controlled valve supported within the vessel and detachably coupled with a pressure water supply and adapted to open as the float drops below a predetermined desired level and allow fresh water to flow into and out of the vessel through the connector pipe and return line and then into the pool for restoring the water in the pool to the predetermined desired level as determined by the position of the float on the water within the vessel being restored to a float position indicative of the predetermined desired level of water in the pool.

5 Claims, 2 Drawing Sheets

APPARATUS FOR AUTOMATICALLY REGULATING WATER LEVEL IN A SWIMMING POOL

BACKGROUND OF THE INVENTION

1. Field of the Invention

This invention relates to apparatus for monitoring and controlling the level of water in a swimming pool and, more particularly, to water level regulating apparatus which can be readily retrofitted to an existing pool without requiring expensive and undesirable reconstruction of the pool and surrounding decking.

2. Description of the Prior Art

Outdoor swimming pools of many shapes, sizes and configurations are in wide use for recreation, therapy and entertainment, most of which are designed or constructed to operate with a predetermined desired water level that must be maintained within relatively close limits to insure proper operation of the water circulation and filter systems associated with the pool. Typically, foreign matter is filtered from the pool water through a recirculation filtration system which includes a circulating pump, a filter and a fluid conduit connecting the filtration system in a circulation loop between a pool outlet and a pool inlet or return. Such filtration systems typically are automatically timed so as to provide an automated removal of foreign matter with only periodic maintenance being required of the pool owner.

Failure to fill the pool to the predetermined desired level after use or evaporation has lowered the pool water level, may result in damage to the associated pump, filter or the recirculation system as a whole. A sufficient drop in water level will render the recirculation system, or at least the skimmer portion, inoperative. In newer pools the water level is automatically adjusted with a simple float valve mounted at pool side within a cavity formed in the decking so as to be in communication with the pool. When the pool level, and thus the level of the water in the cavity, drops, the float valve opens a pipe buried under the deck leading to a fresh water source and water is added to the pool until the desired level is reached and closes the float valve.

However, a large number of swimming pools in current use are not equipped with any means for automatically regulating water level, creating the need for other means for filling the pool to a predetermined safe level. Some pool owners maintain the water level manually by visually observing the level and periodically adding water as required from a garden hose, or the like. Apart from being unsightly, the required continued personal attention is a definite inconvenience, and has spawned attempts by many to develop a system for automatically adjusting the water level in the pool.

Such prior art attempts include mounting a float valve at a pool side location which, when the pool level drops, opens a pipe leading to a source of fresh water and adds water to the pool until the level is restored and closes the float valve. An example of this approach, described in Hodge U.S. Pat. No. 4,342,125, includes a casing adapted for suspension on a pool ladder which contains a float controlled valve detachably coupled to a source of water and adapted to open when the float drops a predetermined distance below a desired level and add water to the pool until the desired level is restored and the float valve closes. Use of this system is limited to pools in which the casing can be conveniently suspended, and the exposed hose or other conduit for coupling water from a source to the casing is visually objectionable and may be a hazard to the safety of users of the pool.

Another system of this general type, adapted for retrofitting an existing pool without requiring reconstruction of the pool, described in Kinkead et al U.S. Pat. No. 4,686,718, monitors the level of water in a pool by monitoring the level of a float within a float chamber supported on water siphoned from the pool recirculation system. When the water level in the float chamber has fallen a predetermined distance below a predetermined level, fresh water from a pressure source is added to the pool until the float detects that the predetermined level has been restored. The float chamber is disposed at least partially below the pool water level, the swimming pool water being siphoned into the float chamber from a place in the pool circulation system above the pool water level, for example, at the suction side of the circulating pump. The system as illustrated requires specialized valves between the fresh water supply line and the recirculation system for supplying fresh water to the pool, adding to the installation cost as well as the cost of maintaining the system in operation.

An observed operational shortcoming of the Kinkead system is its tendency to add recharge water to the pool in spurts; i.e., not a steady flow, with the consequence that it may not be possible to restore the pool water level during the timed "off" period of the recirculation system. During operation, the pump 30 pumps unfiltered water containing debris and abrasives through the valve 50, a modified commercial PVC swing check valve located between the pump and the return line to the pool, causing rapid wear in the seat and flapper of the valve; moreover debris often sticks in the seat/flapper. When this occurs, recharge water is allowed to migrate downward through the pump to the float chamber, causing the float to rise and shutting off the flow of recharge water through valve 74. After the recharge water is shut off, the float drops and the recharge mode is repeated, resulting in the recharging occurring in spurts.

Another problem inherent in the prior art siphon system is that if there is a minor leak in the pump or associated piping—and this frequently happens—air at atmospheric pressure will enter the pump and piping and the system will cease to function.

Another known apparatus for monitoring and controlling water level in a pool, described in Henson U.S. Pat. No. 4,612,949, includes a probe having a water sensing tip positioned above the pool so as to contact the water when the pool is filled to the desired level and to be spaced above the water when the level is lower than the desired level. An electronic control unit coupled to the sensing probe monitors when the sensor tip is in contact with the water and when it is not, and includes a timer for determining the time that has elapsed since the sensor tip was last in contact with the water. When a predetermined time has elapsed, the control unit opens a valve in a fresh water supply line to add water to the pool until the sensor tip contacts the water, indicating that the desired level has been restored.

In one embodiment, the sensing probe is supported in an L-shaped standpipe which, in turn, fits into a vertical cylindrical opening drilled through the pool deck. Wires electrically connecting the sensor probe to the control unit, which is located remotely from the pool, are coursed from the standpipe through the expansion joint space between a pair of adjacent concrete slabs to the edge of the pool. Fresh water is directed into the pool through a conduit buried in or below the pool deck and extending through the wall of the pool. Obviously, retrofitting an existing pool with this control system would be difficult and expensive and require undesirable modification, if not major reconstruction, of the pool and portions of surrounding decking.

These three examples, and there are many more, demonstrate that a need continues to exist for an automatic pool level-adjusting system which does not require complicated valve systems, conduits or controls, which does not require adding a structural anomaly to the pool, which is protected from access or tampering by users of the pool, and which is simple, easy-to-install, and relatively maintenance free thereafter.

SUMMARY OF THE INVENTION

It is a primary object of this invention to provide apparatus for automatically adjusting or regulating the level of water in a swimming pool. Another object of the invention is to provide an automatic monitoring, level detecting and level-adjusting apparatus whose installation does not require modification of the walls or deck of the pool.

It is yet another object of the invention to provide an apparatus for automatically adjusting the level of water in a swimming pool which is remote from the pool itself and out of sight of and not readily accessible to users of the pool.

A still further object of the invention is to provide apparatus for automatically adjusting the level of water in a pool which consists of simple, inexpensive and readily replaceable parts, is easy to install, and is substantially maintenance free.

These and other objects and advantages of the present invention are achieved in an automatic control system for use with a pool having a water inlet, a water outlet, a system including a pump for recirculating pool water between the outlet and inlet and filter means for cleaning the recirculated water. During timed periods that the motor is not running, the control system detects whenever the level of the water in the pool is below a predetermined desired level and in response controls the input of fresh water into the pool for restoring the predetermined desired water level. A relatively small vertically elongated vessel within which a float-actuated valve is supported, is at least partially buried below the pool water level at a location closely proximate the return line from the filter to the pool inlet. A connector pipe extending from the vessel connects the vessel to the return line, which in a typical installation is located about four inches below the desired water level. A second connector pipe connected to the inlet of the valve extends through the wall of the vessel and is adapted for connection to a fresh water supply. The vessel is vented to the atmosphere through a float valve mounted inside its cover.

Suitable float-controlled valves are commercially available from various sources, one such source being Fluidmaster, Inc. of Anaheim, Calif. Their "Fluidmaster 400" valve, although primarily intended as a toilet tank fluid level control valve, is ideally suited for use in the present invention.

When the recirculating motor is stopped, the water in the recirculating system is in a static state and because the return line is below the pool water level, pool water under sub-level pressure enters the vessel through the connecting pipe, the venting float valve allowing the water level inside the vessel to equalize with the level of the pool. In case the pool water level has dropped below the predetermined desired level since the last refill, the float of the valve drops to a corresponding level and opens the valve to allow water to flow from the source into the vessel, out through the connecting pipe and into the return line to the pool inlet. Water is added until the predetermined desired level has been restored, whereupon the float rises to close the valve to stop the flow of water from the source.

When the recirculating pump is next started, under timer control, the increased water pressure in the return line forces water through the connecting pipe into the vessel, expelling air through the venting float valve, until a level is reached at which the float valve closes and the vessel becomes pressurized. The vessel remains pressurized and is isolated from the pool so long as the pump is in operation; when the pump is again stopped the described process will be repeated.

BRIEF DESCRIPTION OF THE DRAWINGS

Other objects, features and advantages of the invention will become apparent and its construction and operation better understood, from the following detailed description, considered with reference to the accompanying drawings, in which.

DESCRIPTION OF THE PREFERRED EMBODIMENT

Figure 1:
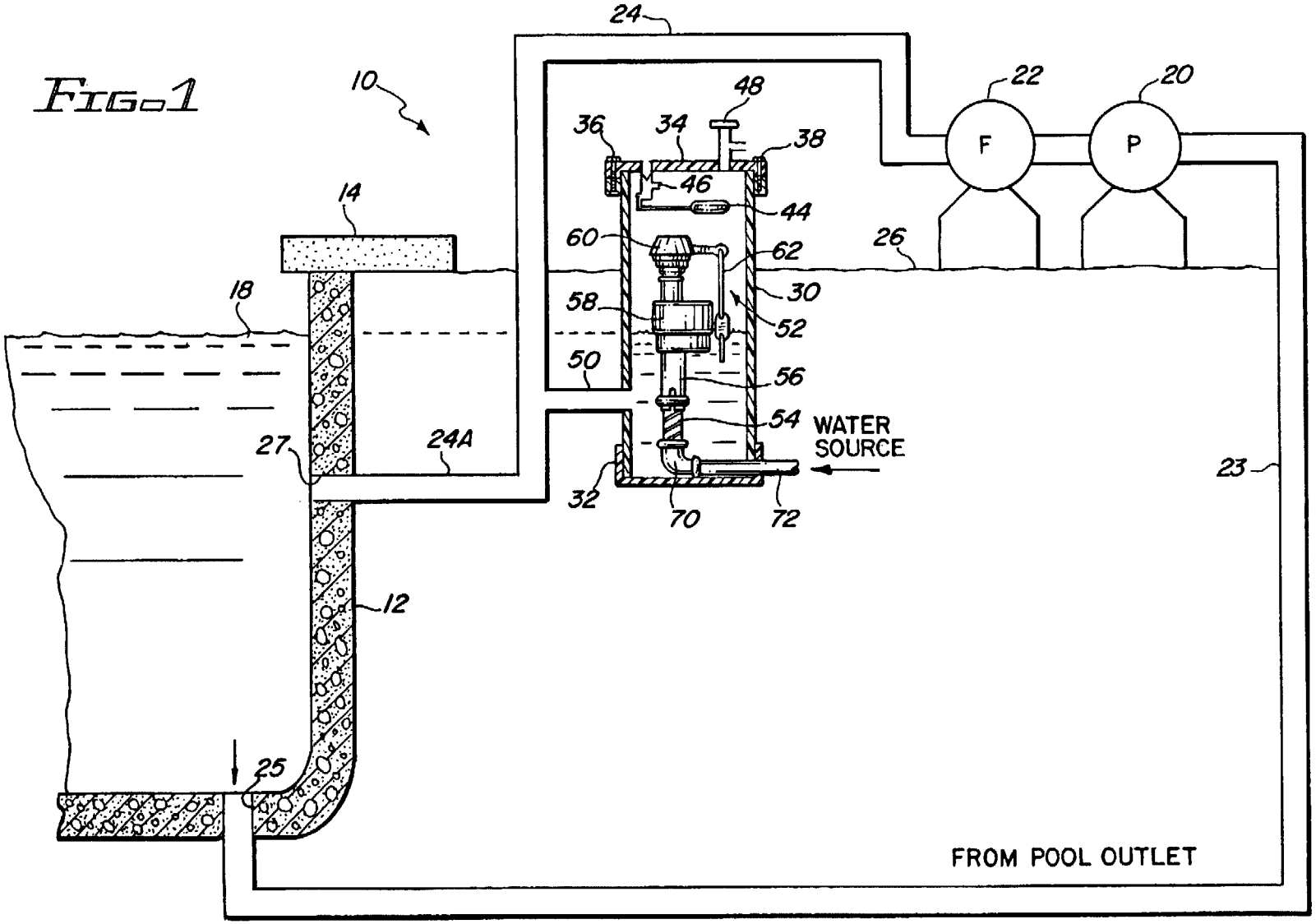
FIG. 1 is a fragmentary diagrammatic view of a swimming pool incorporating the automatic pool water level regulating system of the present invention.

FIG. 1 shows the automatic water level regulating system of the invention in operative association with a conventional swimming pool system 10 including a pool 12 surrounded by a deck 14 and filled with water 16 to a predetermined desired level 18. Foreign matter is filtered from the pool water by a recirculation filtration system which includes a circulating pump 20, a filter 22, and a fluid conduit 23 connecting the filtration system in a recirculation path between a pool outlet 25 and a pool inlet 26, usually located about four inches below the desired water level 18. The pump 20 and filter 22 are usually located remotely from the pool and are supported at ground level 26 on a suitable base. Thus, a portion 24A of the return line from filter 22 to pool inlet 26 is disposed at a level below the desired level of the pool water. Typically, the recirculation system is operated by timing means, not shown, but well-known in the art, wherein the pump 20 is turned on and off periodically to start and stop the recirculation system depending on the need for filtration of the pool water.

Figure 2:
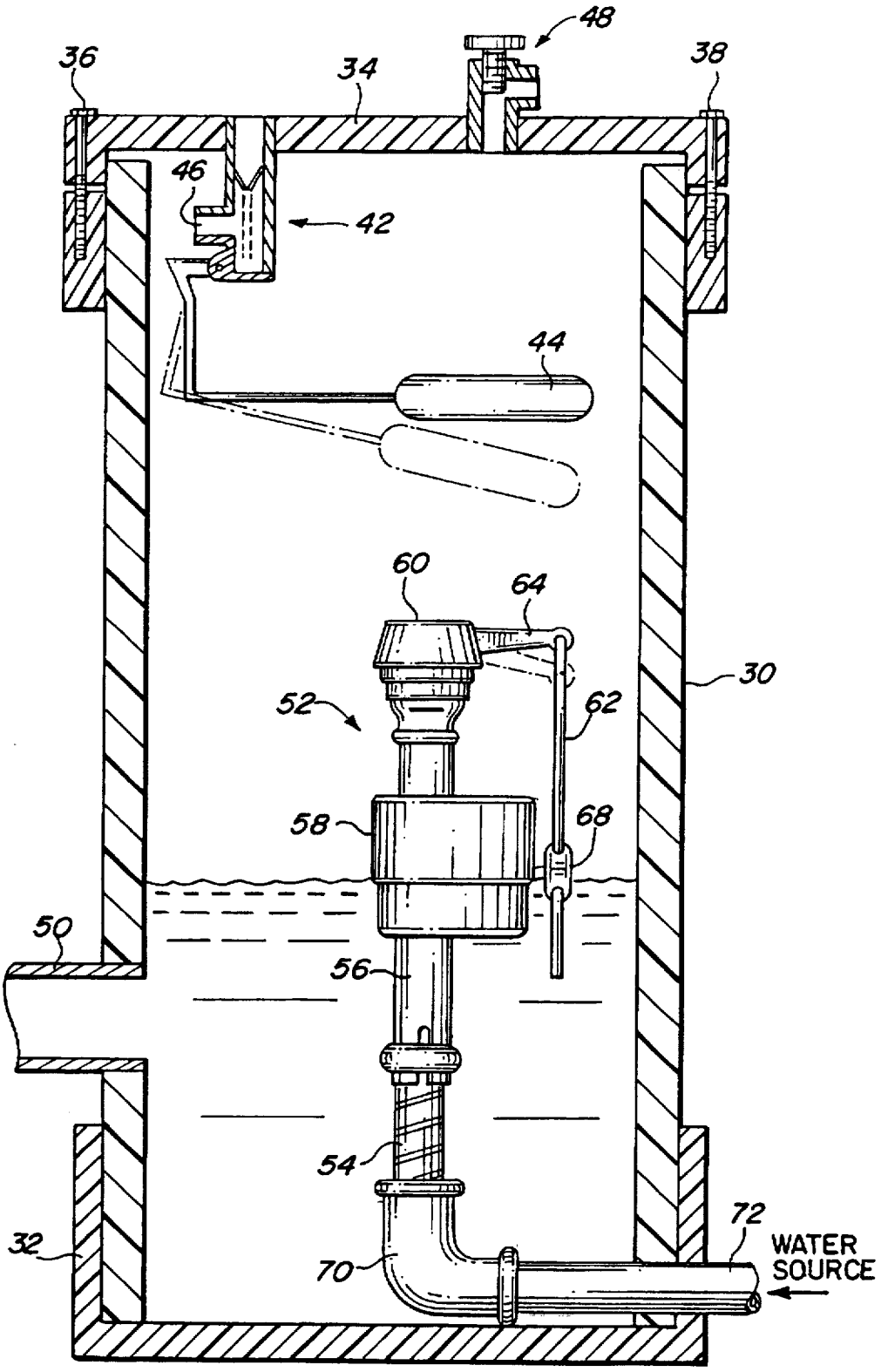
FIG. 2 is an elevation view, partly in section, illustrating details of the regulating system.

Referring also to FIG. 2, the control system according to the invention includes a vertically elongated vessel 30, of right circular cylindrical shape, buried at least partially in the ground 26 at a location in close proximity to the return line 24A to the pool, at a depth at which the vessel straddles the water level 18 in the pool. Typically, vessel 30 may be two feet long and made of six inch diameter PVC pipe. The lower end of the pipe is closed with an adhesively secured cap 32, and the upper end is closed by a cover 34 held in sealing relationship by a plurality of screws, two of which are visible at 36 and 38, which threadably engage a collar 40 adhesively joined to the upper end of the vessel. A conventional, readily available float valve 42 including a float 44 is mounted inside cover 34 and is vented to atmosphere through an opening 46. A bleeder valve 48 is mounted on cover 34 to relieve pressure within the vessel prior to disassembly, but does not otherwise affect the operation of the apparatus.

The interior of vessel 30 is coupled to the pool return line 24A, through a pipe 50, preferably PVC, which is joined to the return line, also typically PVC, at a point near its maximum depth, typically three to four inches below the desired pool water level. The vessel is positioned as near the return line as possible, preferably within about two feet, in which case a one-inch diameter connector pipe 50 is suitable; if it should be necessary to position the vessel more than two feet from the return line, connecting pipe 50 should be 1 ½ inches in diameter to reduce friction loss.

The level of the water in the pool is sensed by a valve mechanism 52 supported generally coaxially within vessel 30. The valve mechanism 52 is not new per se, and may be a commercially available valve assembly of a type frequently used in controlling the water level of toilet tanks. A preferred type of valve assembly is the "Fluidmaster 400" fluid level control valve supplied by Fluidmaster, Inc. of Anaheim, California. The basic components of the valve mechanism are a threaded shank 54 which may be twisted in or out of a valve body 56 to adjust the height of the valve, a hollow float cup 58 mounted on valve body 56 for up and down movement relative thereto, a top 60 closing the upper end of the valve body, and a wire link 62 depending from the free end of a lever arm 64 projecting from the top 60 of the valve body and a clip 68 attached to float cup 58 by which the water level at which the valve closes may be adjusted. The hose connection which in toilet installations would connect with the overflow pipe is omitted in the present application of the flush valve.

The valve assembly 52 is vertically oriented and at its shank end is supported on a 90° pipe elbow 70 which, in turn, rests on the lower end cap 32; shank 54 of the flush valve is threaded into one end of the elbow. The elbow is centered in vessel 30 by a pipe 72 which extends in sealing relationship through the lower end cap and wall of the vessel, and perpendicularly to the axis of the vessel, and is threaded into the other end of elbow 70. Pipe 72, which may be PVC pipe one-inch in diameter and about four inches long, is adapted for connection either by fixed plumbing or with a garden hose, or the like, to a pressure source of fresh water. The height of valve assembly 52 is adjusted by twisting the valve body 56 relative to threaded shank 54, and the location of clip 63 along the length of wire link 62 is adjusted to position float cup 58 so as to close the valve at the predetermined desired level of the pool water.

When this valve is used as intended, namely, to control water level in a toilet tank, a change in water level in the range from about ¾-inch to 1-inch is needed to open the valve; when lever arm 64 is in the horizontal, full line, position, the valve is closed, and water pressure within valve body 56 exerts a force resisting downward movement of the arm 64 until the water level in the tank has dropped sufficiently with respect to float cup 58 so that the added effective weight of float 58, acting through connecting wire link 62, counterbalances the internal pressure, whereupon arm 64 will drop to the position shown in dotted lines, and in so doing open the valve to water flow from the domestic water supply. When the water in the tank has been restored to a level predetermined by the setting of the float, the buoyant force of float 58, transmitted through wire link 62 to lever arm 64, is sufficient to counterbalance the internal pressure and close the valve.

Due to the dynamics of the recirculation system, especially upon starting and stopping the pump-driving motor, the operation of the valve in the present control system differs from the described toilet tank operation in the important respect that the water level in the pool doesn't have to drop ¾-inch to 1-inch below the predetermined desired level in order for the valve to open and allow water to flow from the fresh water source. How this advantageous result is achieved will be understood from a description of the conditions existing within vessel 30 immediately preceding the start of a timed "off" period of recirculating motor 20. When the pump was last started, water was pumped through connector pipe 50 into vessel 30, expelling air through float valve 42, rising to and past valve assembly 52 to a level at which it lifts the float of float valve 42 from the dotted line position to the full line position to close vent 46, whereupon the vessel becomes pressurized and no longer performs any control function. The pressure of pump 20 keeps vessel 30 filled to a level above the predetermined desired pool water level, and thus isolated from the pool, for so long as the pump is running.

When the timer instructs the motor to stop following an "on" filtration period, although the pump 20 stops pumping substantially instantaneously, the rush of water in the return line returning to the pool creates a momentary partial vacuum in connector pipe 50 which pulls the water in vessel 30, and with it float cup 58, down to a level below the level of the water in the pool at which the valve is opened and starts adding water to the pool. When, after a brief period, the system has reached equilibrium, the water in the recirculating filtration system is in a static state and the pressure within the pool at the sub-level location of return line 24A causes pool water in the return line to enter vessel 30 through connecting pipe 50. Any air in the vessel is vented through float valve 42, allowing the water level within vessel 30 to equalize with the level of the water in the pool. If the pool water level has dropped during the period since the water was restored to the desired level, the float cup 58 of valve 52 supported on the water in the vessel drops correspondingly to a position indicative of the pool water level. When the float cup position indicates that the pool water level is below the desired water level, it pulls the arm 64 down to open the valve, allowing fresh water to continue to flow from the water source through pipe 72 into the valve body for discharge from the upper end of the valve assembly into vessel 30 and then out through connecting pipe 50 and return line 24A to the pool inlet 26. When the pool water has been restored to the predetermined desired level, which is also the level of the water in vessel 30, float cup 58 is lifted and through the link 62 raises arm 64 and closes the valve to stop flow of water from the source.

Since sub-level pressure in the pool is used to transfer the level of the pool water to the vessel 30, the effectiveness of the control system is not affected by pool activity causing the water level to be wavy. The sub-level pressure at the depth of the pool inlet is an average pressure, unaffected by transient variations of the water surface.

It will be apparent from the foregoing that the control system according to the present invention regulates the water level in a swimming pool without the need for special or dedicated piping through or over the top of the pool wall. The piping, except from the water source, is invisible; only the upper part of the relatively small vessel 30 can be seen, but being located in close proximity to the pump and filter is hardly noticeable. The system is completely mechanical and hydraulic and requires only three simple and readily replaceable components for its operation: a relatively inexpensive vessel; a simple, relatively inexpensive toilet flush valve; and an inexpensive float valve. Because of its connection to the return line of the pool, the vessel serves the dual functions of serving as the place where the pool water level is sensed and as an inlet for supplying fresh water to the pool, thereby eliminating the requirement for special purpose valves.

While the invention has particular utility as a retrofit for an existing pool that lacks means for automatically regulating water level, it also has application in original installations, particularly large public pools which attract large numbers of users, including children, who may be temped to tamper with a conventional pool side float valve protected only by a fragile plastic disk. The partially buried pressure vessel of the present invention, installed near the pump and filter and removed from the pool, would less likely attract mischief.

While the invention has been particularly described and illustrated with reference to a preferred embodiment, it will be understood by those skilled in the art that various changes and modifications can be made without departing from the true spirit and scope of the invention which is limited only by the appended claims.

I claim:

1. An automatic control system for use in a swimming pool system including a pool having an inlet located at a level which is lower than a predetermined desired pool water level and an outlet, and a recirculation system for circulating pool water from the pool outlet to the pool inlet including a motor-driven pump having timing means for turning the motor on and off periodically, filter means for cleaning the recirculated water, and conduit means including a return conduit connected between said filter means and the pool inlet and a pressure source of fresh water, for detecting, during periods when the pump is turned off, when the level of the water in the pool is below said predetermined desired level and for adding fresh water to the pool in response to the detected level for automatically restoring the pool water to said predetermined desired level, comprising:

a vertically elongated vessel having closed upper and lower ends and adapted to be operatively disposed closely proximate said return conduit at least partially below the water level in said pool;

first connector pipe means extending from near the lower end of said vessel adapted for connecting said vessel to said return conduit at a level below said predetermined desired pool water level for allowing swimming pool water under sub-water level pressure to enter said vessel and rise to a level corresponding to the pool water level;

a vertically elongated first valve assembly means supported within said vessel and connected to second connector pipe means extending from near the lower end of said vessel and adapted for connection to the pressure source of fresh water, said first valve assembly means including first float means for monitoring the water level in said vessel as a measure of the water level in said swimming pool and being adapted to open said first valve means in response to said first float means dropping below a level indicative of said predetermined desired level to allow water to flow from the fresh water source into and out of said vessel through said first connector pipe into said return conduit and then into said pool, and to close and terminate flow of fresh water from the source in response to said first float means rising to a level indicative of said predetermined desired level; and second valve means mounted inside the upper end of said vessel including second float means for monitoring the water level in said vessel, said second valve means normally venting said vessel to atmosphere and adapted to close in response to the level of water within said vessel rising, in response to said pump being turned on, to a level above said predetermined desired level by a predetermined amount.

2. The automatic control system as defined in claim 1, wherein said first valve assembly means comprises a vertically oriented shank portion connected at a lower end to said second connector pipe means, a vertically oriented body portion adjustably connected to an upper end of said shank portion, and wherein said first float means comprises a float cup vertically slidable on said body portion.

3. An automatic control system for use in a swimming pool system including a pool having a pool inlet located at a lower level than a predetermined desired pool water level, a pool outlet, and a recirculation system for circulating pool water from the pool outlet to the pool inlet including a motor-driven pump having timing means for turning the motor on and off periodically, filter means for cleaning the recirculated water, and conduit means including a return conduit connected between said filter means and said pool inlet and a pressure of fresh water, for detecting, during periods when the pump is turned off, when the level of the water in the pool is below said predetermined desired level and for adding fresh water to the pool in response to the detected level for automatically restoring the pool water to said predetermined desired level, said automatic control system comprising:

a vertically elongated cylindrical vessel having closed upper and lower ends and adapted to be disposed in close proximity with said return conduit at least partially below the water level in said pool;

means for operatively coupling said vessel to said return conduit at a level below said predetermined desired level for allowing swimming pool water under sub-water level pressure to enter said vessel and rise to a level corresponding to the pool water level when said pump is not operating and for allowing water in the return conduit to enter said vessel and rise to a level above the pool water level for isolating said vessel from said pool whenever said pump is operating;

normally closed valve means supported within said vessel having an inlet connected to pipe means extending from near the lower end of said vessel and adapted for connection to the source of fresh water under pressure, said valve means including first float means for monitoring the water level in said vessel as a measure of water level in said swimming pool, said valve means adapted to be opened to allow water to start flowing from the source immediately following cessation of operation of said pump by said first float means dropping in response to water being drawn from said vessel by a partial vacuum created by the rush to the pool inlet of water in said return conduit and to remain open so long as said first float means is below a level indicative of said predetermined desired level to allow water to continue to flow from the source into and out of said vessel, into said return conduit and then into said the pool, and to close and terminate flow of water from the source in response to said first float means rising to-a level indicative of said predetermined desired level; and normally open float-actuated valve means mounted inside the closed upper end of said vessel for venting said vessel to atmosphere whenever said pump is not operating and adapted to be closed, whenever said pump is operating, in response to the float thereof sensing that the level of water within said vessel has risen to a level higher by a predetermined amount than said predetermined desired level for isolating said vessel from said pool.

4. The automatic control system as defined in claim 3, wherein said normally closed valve means comprises a vertically oriented shank portion having an inlet at a lower end thereof, a vertically oriented body portion adjustably joined to an upper end of said shank portion, and wherein said first float means comprises a float cup vertically slidable on said body portion.

5. The automatic control system as defined in claim 4, wherein the pipe means adapted for connection to the source of fresh water extends radially from said vessel and is connected at an inner end to the lower end of said shank portion by a 90° elbow supported on the lower end of said vessel.

* * * * *